US008757174B2

(12) United States Patent
Barnes et al.

(10) Patent No.: US 8,757,174 B2
(45) Date of Patent: Jun. 24, 2014

(54) HAIR COLOR FOIL HOLDER

(71) Applicant: Off Camber Gear, LLC, Scottsdale, AZ (US)

(72) Inventors: Benjamin Barnes, Scottsdale, AZ (US); Michael Barnes, Scottsdale, AZ (US)

( * ) Notice: Subject to any disclaimer, the term of this patent is extended or adjusted under 35 U.S.C. 154(b) by 0 days.

(21) Appl. No.: 13/669,299

(22) Filed: Nov. 5, 2012

(65) Prior Publication Data

US 2014/0123996 A1 May 8, 2014

(51) Int. Cl.

| | |
|---|---|
| ***A45D 7/02*** | (2006.01) |
| ***A45D 44/00*** | (2006.01) |
| ***B65D 1/34*** | (2006.01) |
| ***B65D 6/04*** | (2006.01) |
| ***A47B 25/00*** | (2006.01) |
| ***A47B 37/00*** | (2006.01) |
| ***A45D 44/02*** | (2006.01) |
| ***A45D 44/04*** | (2006.01) |

(52) U.S. Cl.

CPC ..... *A45D 44/02* (2013.01); *A45D 44/04* (2013.01)

USPC ..... 132/212; 132/333; 206/557; 206/565; 108/43

(58) Field of Classification Search

CPC ..... A45D 44/00; A45D 44/02; A45D 44/04; A45D 44/14; A47B 23/002

USPC ..... 132/212, 200, 207, 208, 213, 108, 270, 132/333, 221, 222, 317, 319, 320, 73, 216, 132/331, 332; 248/447, 448, 449, 454, 248/125.8, 423, 424, 188.5, 207, 521; 206/557–563, 1.7, 565, 581, 823; 211/123, 126.1, 126.12, 126.15, 211/126.16; 224/182, 623, 625, 637, 638; D28/7, 17, 20, 28, 9, 10, 61, 99, 73; 24/3.1; D7/550.1, 552.1, 552.2; D24/227; 220/811, 812, 815; 4/520, 4/522, 523, 551, 517, 661, 521; 108/43, 108/5, 50.14, 102, 137, 147.19, 149, 161; 221/185, 283

See application file for complete search history.

(56) References Cited

U.S. PATENT DOCUMENTS

| | | | | | |
|---|---|---|---|---|---|
| 368,426 | A | * | 8/1887 | Ruttmann et al. | 248/188.5 |
| 1,040,067 | A | * | 10/1912 | Washburn | 248/449 |
| 2,112,669 | A | * | 3/1938 | Halas | 297/182 |
| 2,126,051 | A | * | 8/1938 | Sievers | 223/109 R |
| 2,163,755 | A | * | 6/1939 | Labruzzo | 4/520 |
| D132,795 | S | * | 6/1942 | Sommers | D28/20 |
| D132,851 | S | * | 6/1942 | Cooper | D28/75 |
| 2,375,643 | A | * | 5/1945 | Germanotta | 224/201 |
| 2,803,292 | A | * | 8/1957 | Nyberg | 108/137 |
| 2,954,077 | A | * | 9/1960 | Wanner | 4/522 |

(Continued)

*Primary Examiner* — Vanitha Elgart

(74) *Attorney, Agent, or Firm* — Etherton Law Group, LLC

(57) ABSTRACT

A foiling device has a plate for receiving one or more foil sheets and a telescoping brace attached to the plate and configured to be set in an extended position and a retracted position to lengthen or shorten the device as needed by the stylist. A substantially flexible stabilizing cap may be attached to the proximal end of the brace, the cap contacting the stylist's chest when in use. The cap may be shaped and textured to increase contact surface area and friction and hold the device against the stylist's clothes. A base may be attached to the plate to space the plate away from the surface on which it rests, making it easier to pick up the device. One or more retaining mechanisms may be positioned on the plate to retain the foil sheets on the surface.

5 Claims, 9 Drawing Sheets

(56) References Cited

U.S. PATENT DOCUMENTS

| | | | | | |
|---|---|---|---|---|---|
| 3,094,323 | A | * | 6/1963 | Catania | 271/33 |
| 3,809,383 | A | * | 5/1974 | Ptacek | 269/91 |
| 4,224,954 | A | * | 9/1980 | Stahl | 132/208 |
| 4,401,233 | A | * | 8/1983 | Frey | 221/36 |
| 4,880,019 | A | | 11/1989 | Roubo | |
| 4,991,738 | A | * | 2/1991 | Peterson | 221/1 |
| 5,023,963 | A | * | 6/1991 | Vogel | 4/521 |
| 5,349,970 | A | | 9/1994 | Razzouq | |
| 5,433,225 | A | * | 7/1995 | Liggett et al. | 132/208 |
| D366,379 | S | * | 1/1996 | Graeber | D6/511 |
| 5,634,568 | A | * | 6/1997 | Wawrzyniak | 220/510 |
| 5,819,766 | A | * | 10/1998 | Craigen | 132/314 |
| 6,050,531 | A | * | 4/2000 | Wilcox | 248/188.5 |
| 6,237,608 | B1 | * | 5/2001 | Kari | 132/208 |
| 6,527,243 | B1 | * | 3/2003 | Kume, Jr. | 248/448 |
| 6,913,230 | B2 | * | 7/2005 | Wells | 248/127 |
| 6,923,485 | B1 | * | 8/2005 | Bauswell | 294/3.5 |
| 7,222,629 | B1 | * | 5/2007 | Han | 132/216 |
| 7,537,120 | B1 | * | 5/2009 | Cardenas | 206/581 |
| 7,628,160 | B2 | | 12/2009 | Winup | |
| D630,452 | S | * | 1/2011 | Robbins et al. | D6/406.3 |
| D669,223 | S | * | 10/2012 | Lee et al. | D28/73 |
| D670,859 | S | * | 11/2012 | Palacios | D28/9 |
| 2004/0079845 | A1 | * | 4/2004 | Wilcox | 248/188.5 |
| 2005/0194287 | A1 | * | 9/2005 | Lien et al. | 206/565 |
| 2005/0224090 | A1 | | 10/2005 | Rizzo | |
| 2008/0202976 | A1 | * | 8/2008 | Burgess et al. | 206/558 |

* cited by examiner

HAIR COLOR FOIL HOLDER

FIELD OF INVENTION

This invention relates to devices for aiding in the treatment of hair with colorants and other chemicals. This invention relates particularly to an apparatus that facilitates separating hair into treatable sections, applying a chemical to the section, and covering the treated hair with a foil or other shield.

BACKGROUND

The foil treatment method is widely known among professional hair stylists as a common but difficult approach to applying chemicals, in particular hair colorants, to a client's hair. In the foil treatment method, a sheet of aluminum foil is held under a discrete section of hair, the desired chemical is applied to the section of hair, and then the sheet of foil is rolled or folded over itself toward the scalp to form an enclosure that protects the section of hair while the chemical does its work. The process is repeated until all of the client's hair that is to receive the treatment is covered in foil sheets.

Performing this treatment manually has several drawbacks. The stylist must perform several tasks simultaneously, including holding or otherwise being able to reach the stack of foil sheets, the chemical and its applicator, while also positioning each foil sheet, separating the hair into appropriately-sized sections, applying the chemical, and folding up the foil sheet. It is difficult to, by hand, ensure that each foil sheet abuts the scalp to hold the chemical on the roots of the hair. The degree of difficulty increases proportionately with the length of the client's hair, requiring corresponding increases in foil size and amount of time needed to apply chemicals and fold foil sheets. A device that aids a stylist in performing the foil treatment method is needed.

The method was greatly aided by the invention of the color board, a device similar to that described in U.S. Pat. No. 5,349,970. A color board is a substantially thin, rigid, planar, rectangular device that is about the width of a typical foil sheet and a length of one to two feet. A stylist could place a foil sheet on the board and fit the board between his chest and the client's scalp. This allows the foil sheet to be placed at the client's scalp, and by friction fit allows the stylist to work with both hands. However, the color board also has several drawbacks. Being a fixed length, the board does not equally accommodate hair of varying lengths or stylists of varying heights, girths, or arm lengths. The foil sheets are not secured on the board, and so cannot be stacked and frequently slip out of place. The rigid ends of the board can be uncomfortable or unwieldy to secure against the stylist's chest. Being thin and planar, the board is difficult to pick up when laying on a table or other flat surface. A foiling device that corrects these drawbacks is needed.

Therefore, it is an object of this invention to provide a device to aid a hair stylist in applying the foil treatment method. It is a further object that the device be usable by any stylist on any length of hair. It is a further object that the device be comfortable for the stylist when pressed against his or her chest. It is another object that the device securely hold one or more foil sheets during use. It is another object that the device be easy to pick up and hold.

SUMMARY OF THE INVENTION

A foiling device has a plate for receiving one or more foil sheets commonly used for the foil treatment method of applying chemicals to hair. One or more retaining mechanisms may be positioned on the plate to retain the foil sheets on the surface. A telescoping brace is attached to the plate and extends proximally toward the would-be stylist using the device. The brace may be set in at least two positions—an extended position and a retracted position—and preferably may be set and locked at any position between the extended and retracted positions. A substantially flexible stabilizing cap may be attached to the proximal end of the brace, the cap contacting the stylist's chest when in use. The cap may be textured to increase friction and hold the device against the stylist's clothes. A base, which is preferably wedge-shaped, may be attached to the plate to space the plate away from the surface on which it rests, making it easier to pick up the device.

DETAILED DESCRIPTION OF THE INVENTION

Figure 1:
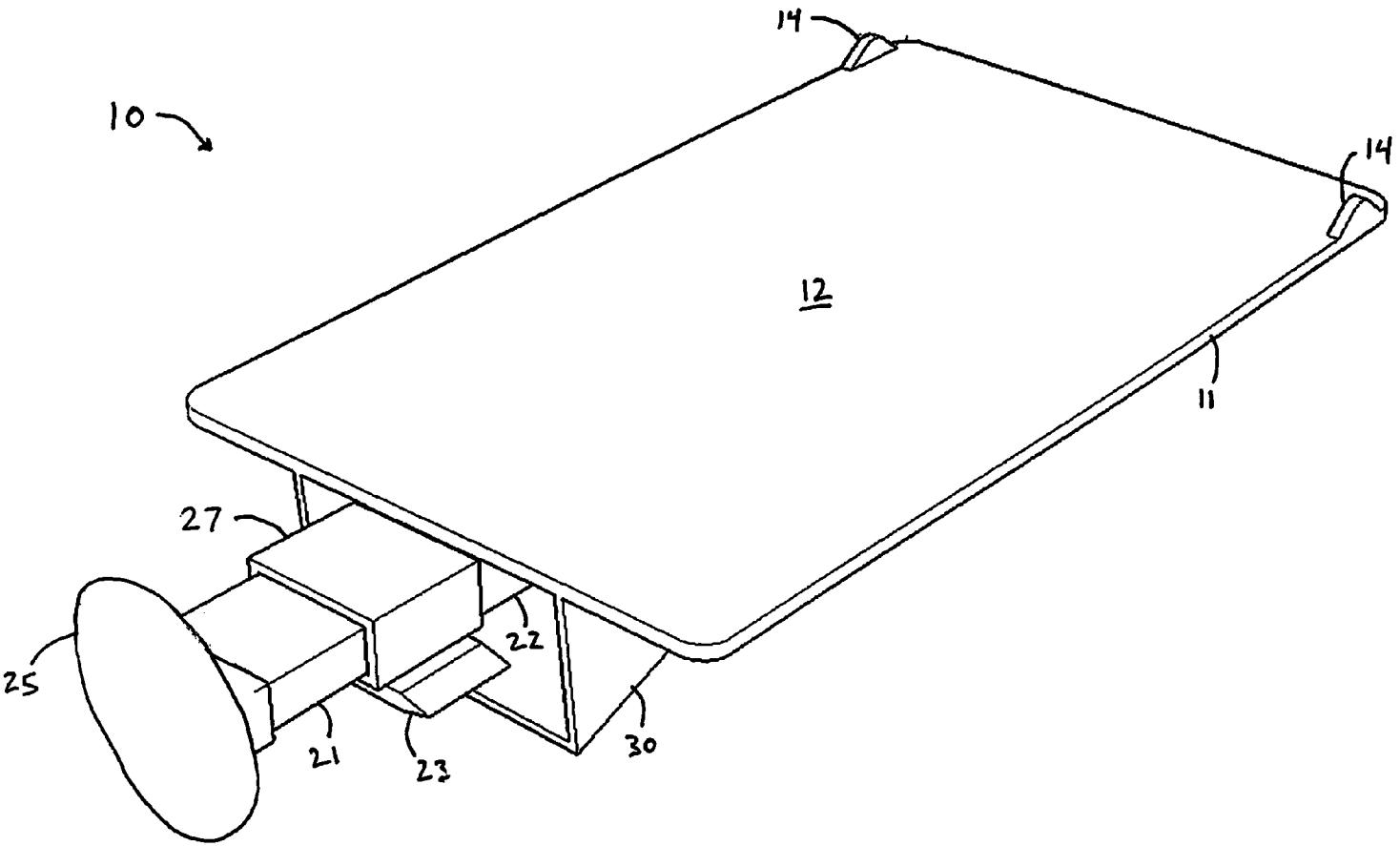
FIG. 1 is a front top left perspective view of the preferred embodiment of the present invention.
Figure 2:
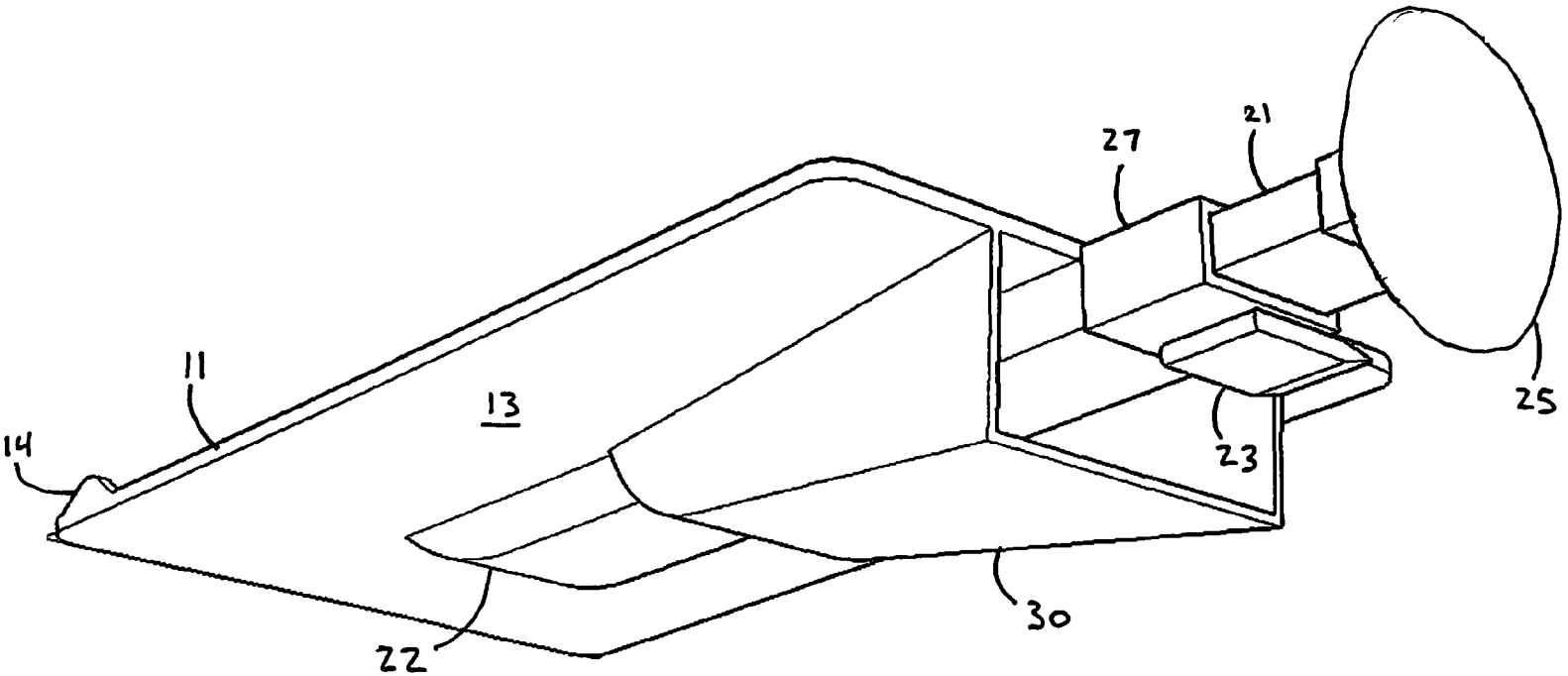
FIG. 2 is a front bottom right perspective view of the preferred embodiment of the present invention.
Figure 3:
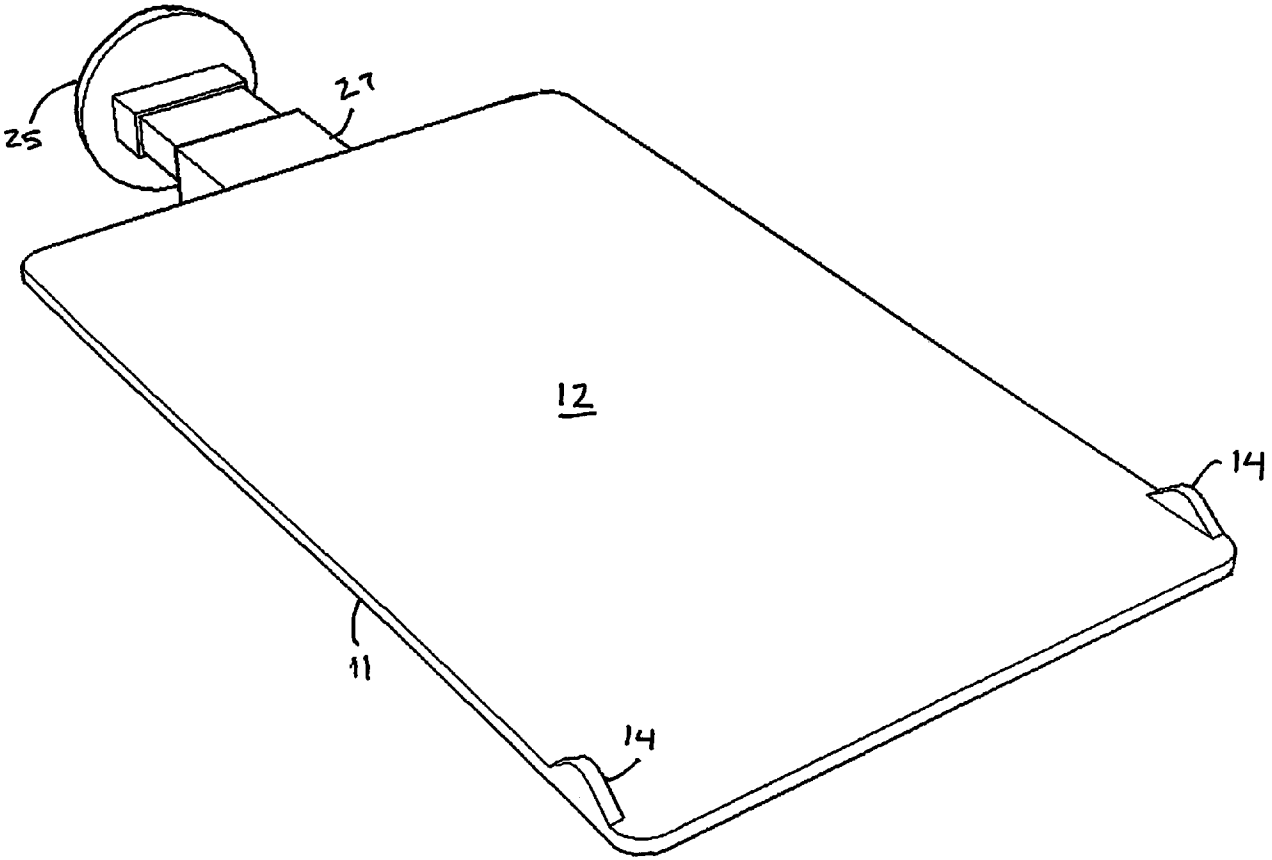
FIG. 3 is a rear top left perspective view of the preferred embodiment of the present invention.
Figure 4:
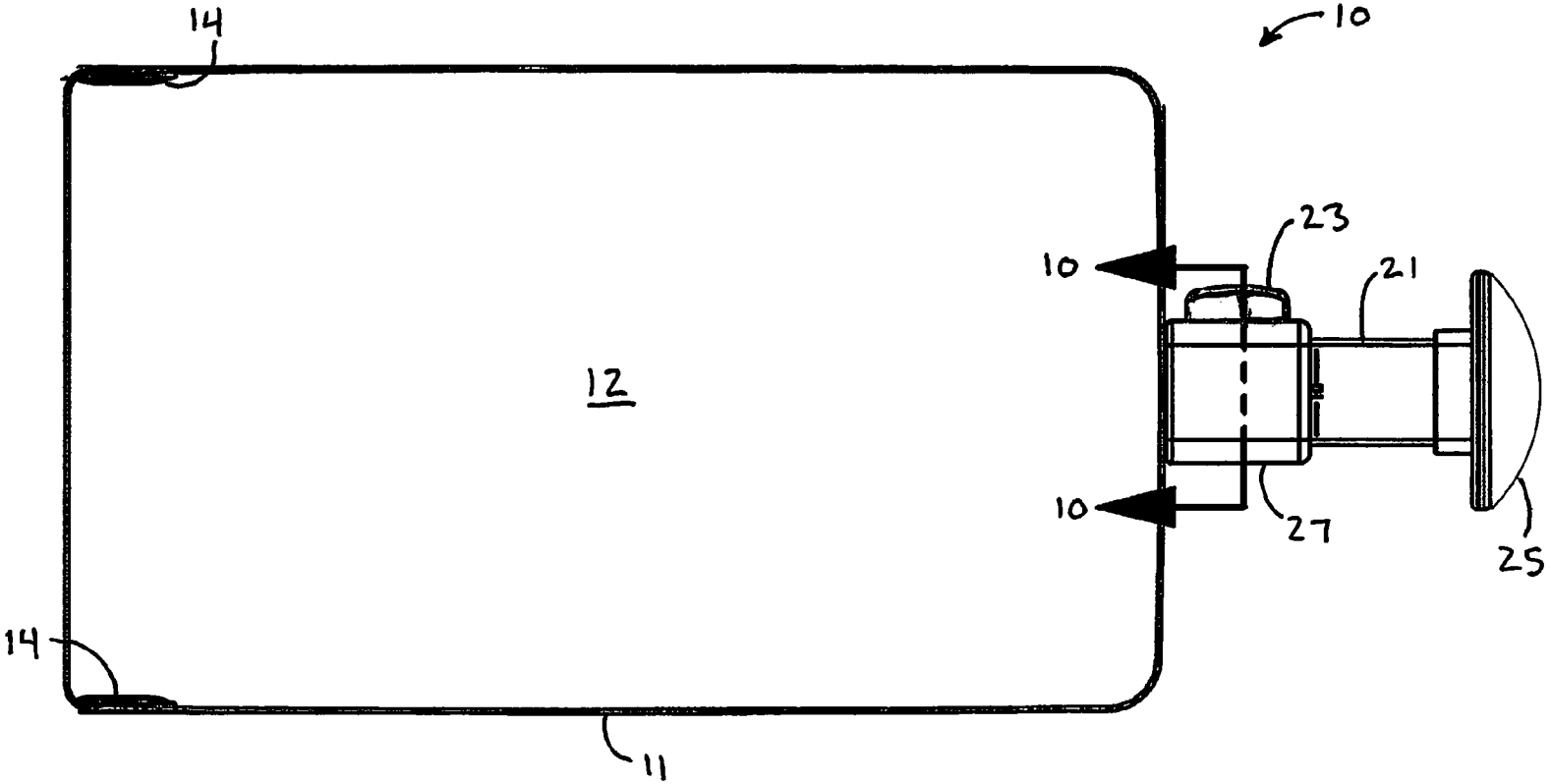
FIG. 4 is a top view of the preferred embodiment of the present invention.
Figure 5:
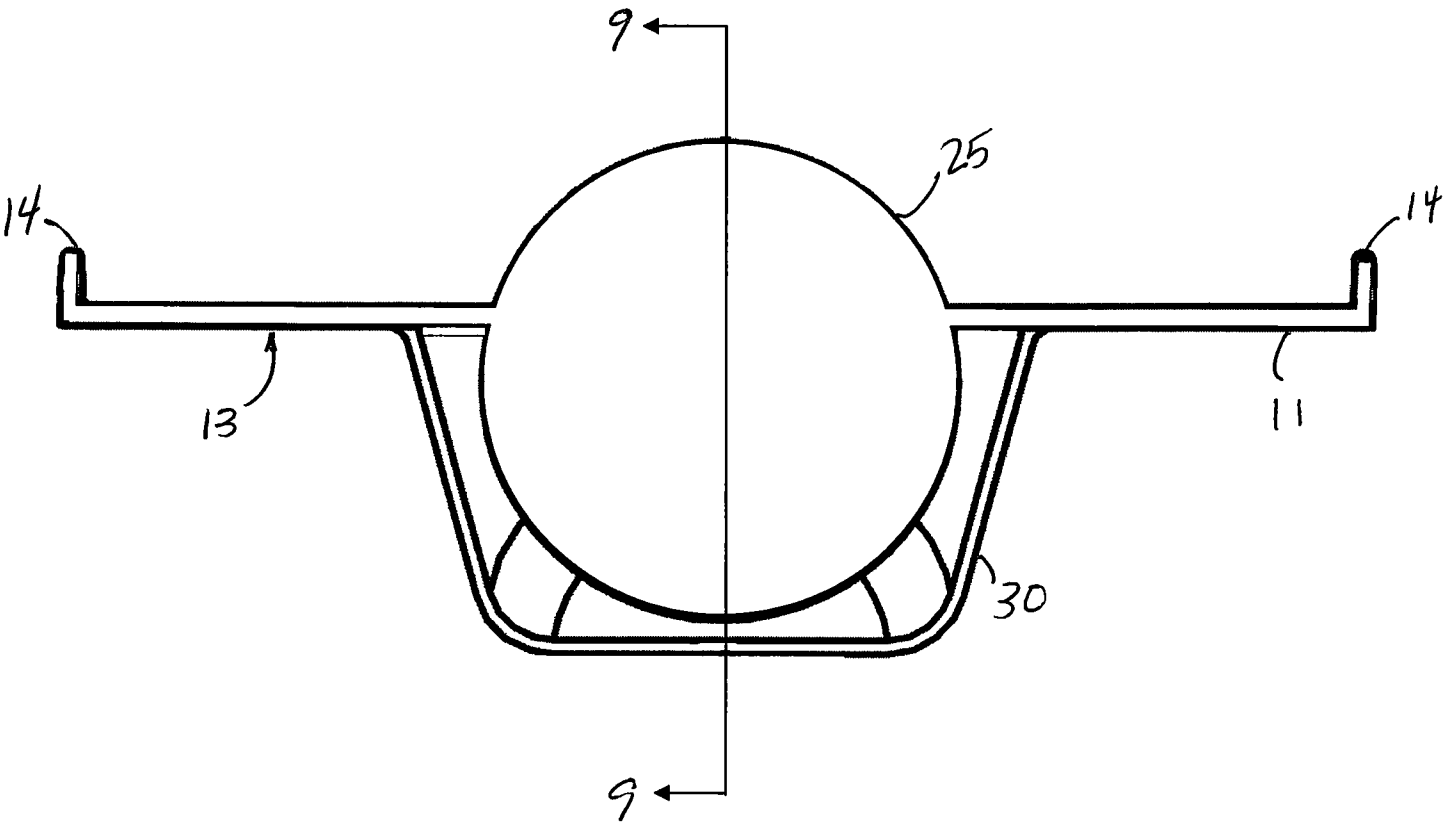
FIG. 5 is a front view of the preferred embodiment of the present invention.
Figure 6:
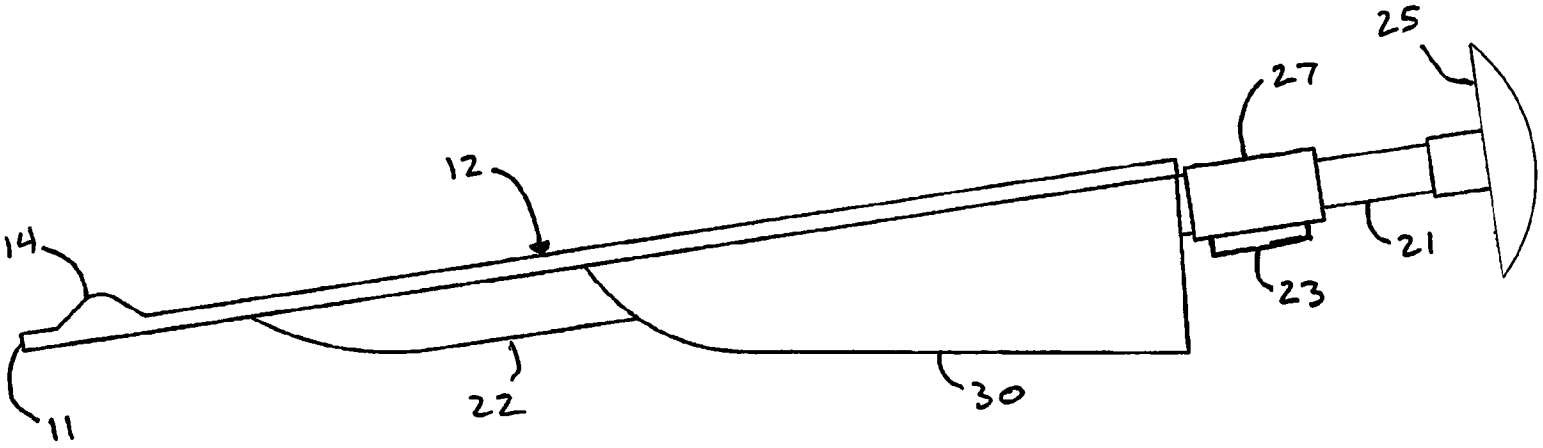
FIG. 6 is a right side view of the preferred embodiment of the present invention.
Figure 7:
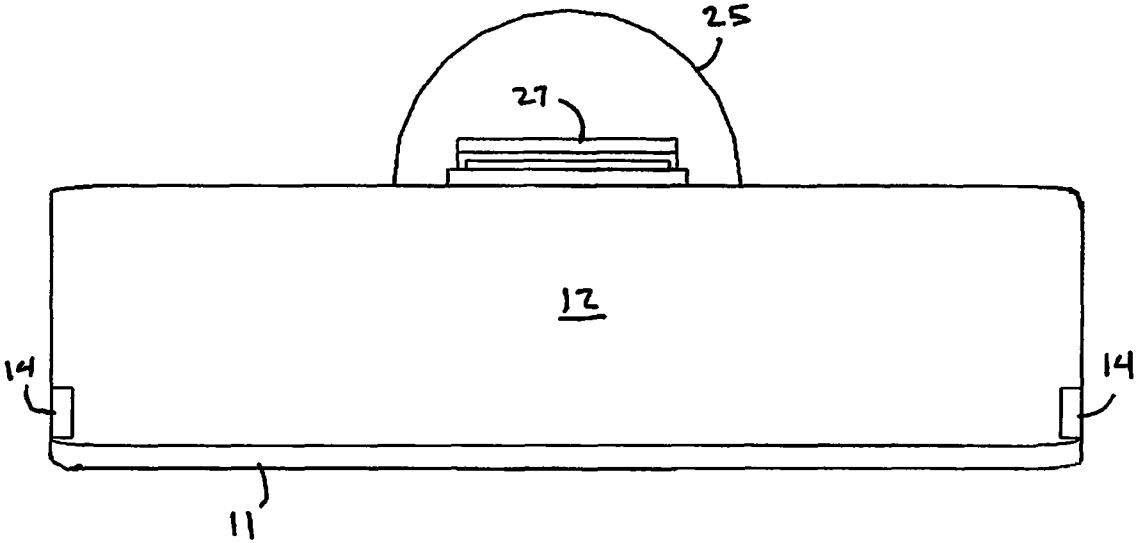
FIG. 7 is a rear view of the preferred embodiment of the present invention.
Figure 8:
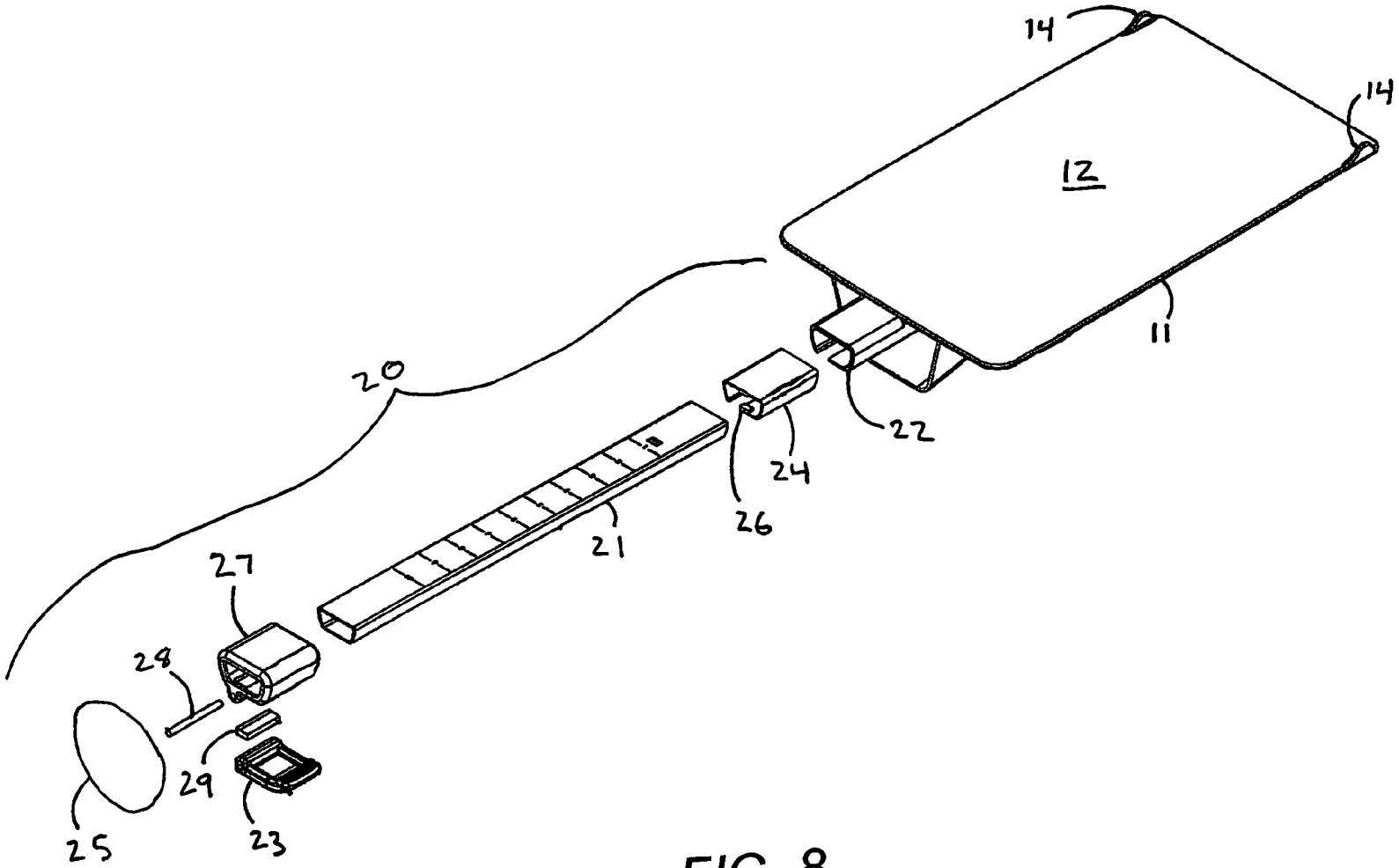
FIG. 8 is a front top left perspective exploded view of the preferred embodiment of the present invention.
Figure 9:
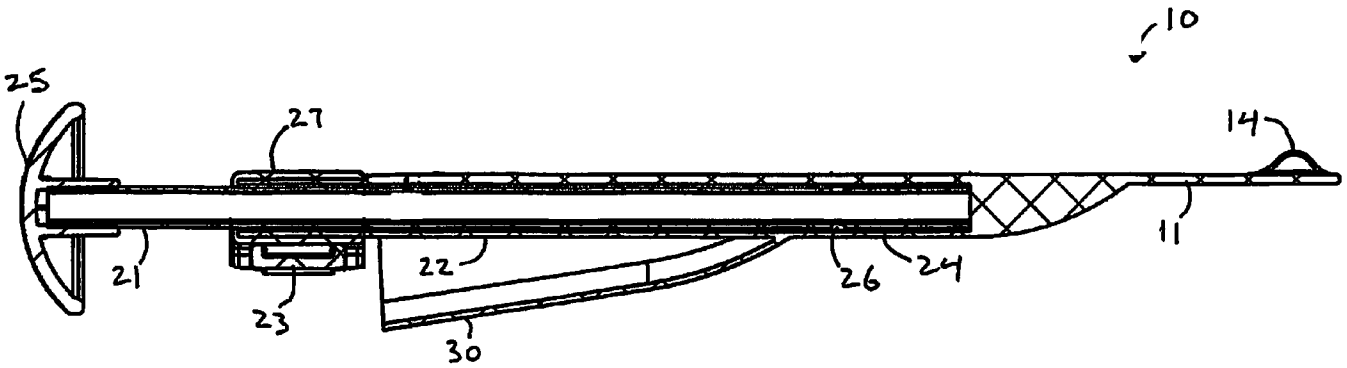
FIG. 9 is a left side cross-sectional view of the preferred embodiment of the present invention taken along the line 9-9 of FIG. 5.
Figure 10:
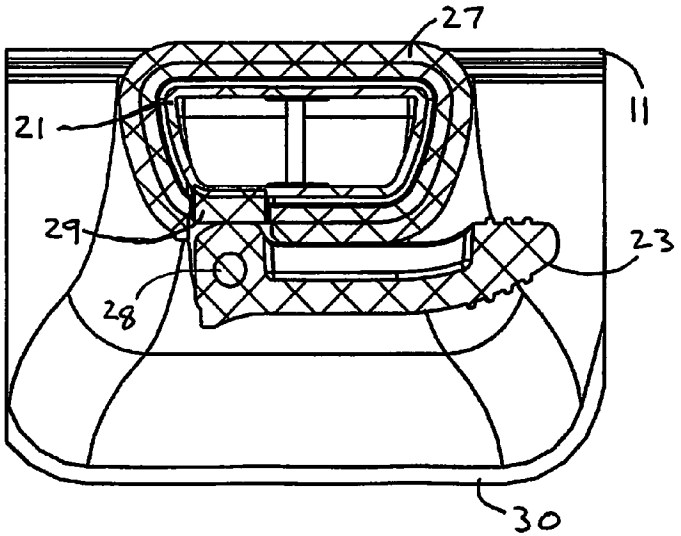
FIG. 10 is a front cross-sectional view of the preferred embodiment of the present invention taken along the line 10-10 of FIG. 4.

Referring to FIGS. 1-10, there is illustrated the preferred embodiment of the present invention designated generally as 10 which is used to apply foil sheets and chemicals to a person's hair, as an aid to a stylist performing the foil treatment method of applying the chemicals to the hair. The device 10 elements described below allow the stylist to apply the foil treatment with greater speed, more closely to the scalp, and without unwanted bleeding of chemicals onto proximal hairs, when compared to known related tools. A plate 11 receives one or more foil sheets on the planar foil surface 12. The plate 11 and foil surface 12 may be any size and shape suitable for receiving the foil sheets, but are preferably rectangular with rounded corners, having a width of about 6.25 inches and a length of about 10.5 inches. These dimensions facilitate the use of any foil sheet up to 6 inches wide, which is the widest commonly-used foil sheet. The plate 11 preferably has a minimal thickness that still allows the plate 11 to be substantially rigid. In the preferred embodiment, the plate 11 is made of plastic and has a thickness of about 0.125 inches. The foil surface 12 may be textured or coated to enhance the friction between it and the foil sheets, better retaining the sheets on the surface 12. The plate 11 has an attachment surface 13 that is preferably substantially planar and parallel to the foil surface 12, and attaches to one or both of a brace and a base 30 as described below.

One or more retaining mechanisms may be attached to or integral with the plate 11 and configured to aid in retaining the foil sheets by preventing the foil sheets from sliding off of the foil surface 12. In one embodiment, the retaining mechanisms are tabs 14 that project outward from, and preferably substantially perpendicularly to, the foil surface 12. The tabs 14 are preferably located on opposite corners of the distal end of the plate 11. In this configuration, the tabs 14 may retain one or more foil sheets, and preferably retain a stack of foil sheets, on the plate 11 while the device 10 is in use. Moreover, the tabs 14 allow the stylist to tilt the plate 11 around its longitudinal axis while applying the foil sheets because the foil sheets are retained on the plate 11 by the tabs 14. The tabs 14 may extend longitudinally along the plate 11 for a portion of or the entirety of the plate's 11 length, with a longer tab 14 being better suited to retain the foil sheets in an aligned stack.

A telescoping brace 20 is attached to the plate 11 at the plate's 11 attachment surface 13, or alternatively may be attached to the base 30 described below. The brace 20 extends proximally from the proximal end of the plate 11 and is preferably centered along the centerline or longitudinal axis of the plate 11. The brace 20 comprises a shaft 21 and mated sheath 22 into which the shaft 21 fits and may be pulled out from a retracted position to an extended position. The shaft 21 may be any length suitable to maximize the versatility of the device 10 for use by any stylist on any hair, regardless of the size of the stylist or length or thickness of the hair. In one embodiment, the shaft 21 and sheath 22 are preferably arranged so that the device 10 is about 14 inches long when the brace 20 is fully retracted, and about 18-20 inches long when the brace 20 is extended. The shaft may comprise a marking system to indicate to the stylist how far the brace 20 is extended, allowing the stylist to easily adjust the brace 20 to the optimum length once that length is determined. The shaft 21 may be constrained in the sheath 22 by any conventional means, such as increasing the thickness of the shaft 21 at the distal end for an interference fit, or using a mated tongue and groove between the parts. Preferably, a sleeve 24 having one or more guides 26 is positioned inside the sheath 22 and receives the shaft 21. The guides 26 interface with the shaft 21 to prevent the shaft 21 from being pulled completely out of the sheath 22.

The brace 20 may be further configured to be set in any number of intervening positions between the retracted and extended positions. In one embodiment, the shaft 21 may comprise a series of notches that cooperate with a pawl or retractable pin inside the sheath 22, the cooperation of which pieces serves to retain the brace 20 in a desired position. In other embodiments, the brace 20 may comprise a locking mechanism that locks the brace in each position. Preferably, the locking mechanism is a compression latch 23 cooperating with a cam lock to lock the shaft 21 in place by friction fit. The cam lock comprises a lock base 27 attached to the sheath 22 and surrounding the shaft 21, and further comprises a block 29 retained by the lock base 27 and configured to apply pressure to the shaft 21 when the cam lock is locked. Specifically, the latch 23 is attached to the lock base 27 by a hinge pin 28. When the latch 23 is closed, it presses the block 29 against the shaft 21. The latch 23 may be opened to release the pressure of the block 29 so that the shaft 21 may slide proximally and distally within the sheath 22. In another embodiment, the shaft has a circular cross section and cooperates with a matedly-threaded sheath that also has a circular cross section.

A stabilizing cap 25 may be permanently or removably attached to or integral with the proximal end of the shaft 21 so that it contacts the stylist while the device 10 is in use. The cap 25 may be rigid or flexible, but is preferably flexible to at least partially conform to the stylist's chest. This conformance allows the stylist to comfortably and effectively retain the device 10 at an angle offset laterally from perpendicular to the stylist's chest. Most preferably, the cap 25 is made of a substantially flexible rubber. The cap 25 may be textured on its contact surface to offer a degree of traction against the stylist's clothes. The contact surface may have any planar or three-dimensional shape suitable for stabilizing the device 10 against the stylist. In the preferred embodiment, the contact surface is convex, has a circular perimeter, and is substantially larger than the end of the shaft 21. This provides a large surface area for contact against the stylist's chest, typically aligned with the stylist's sternum. Further, this allows the cap 25 to be used as a handle to push and pull the shaft 21 into the desired position with respect to the sheath 22.

A base 30 may be attached to or integral with the plate 11 at the attachment surface 13. The base 30 is configured to space the plate 11 away from the surface on which the device 10 rests and may be any shape suitable for accomplishing the spacing. Preferably, the base 30 is wedge-shaped, having a triangular or trapezoidal profile when viewed from the side. This design elevates only one end, preferably the proximal end, of the plate 11 so that the stylist knows the orientation of the device 10 when he picks it up. Alternatively, the base 30 may have a square or rectangular profile from the side, so that the plate 11 is substantially parallel to the surface on which the device 10 rests. The base 30 is narrower than the plate 11 so that the plate 11 may be gripped on one or both sides. The base 30 may be solid or hollow, and is preferably substantially hollow to reduce the weight of the device 10. Additionally, a hollow base 30 allows the brace to be attached to the attachment surface 13 of the plate 11 as illustrated. The sheath 22 may pass partially or completed through the base 30. Alternatively, the sheath 22 of the brace may be formed into or integral with the base 30.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

We claim:

1. An apparatus for aiding a stylist in the treatment of the hair on a person's head, the apparatus comprising:

a) a plate having a foil surface, a proximal end and a distal end; and b) a telescoping brace connected to and projecting from the proximal end of the plate, the brace configured to hold the apparatus under tension between the stylist's chest and the person's head while the stylist is treating the person's hair, wherein the brace comprises a stabilizing cap that contacts the stylist.

2. The apparatus of claim 1 wherein the stabilizing cap is substantially flexible such that the stabilizing cap at least partially conforms to the stylist's chest at the point of contact.

3. An apparatus for aiding a stylist in the treatment of the hair on a person's head, the apparatus comprising:

a) a plate having a proximal end and a distal end, the plate held under tension between the stylist's chest and the person's head while the stylist is treating the person's hair;

b) one or more retaining mechanisms attached to the plate near the distal end, the retaining mechanisms projecting outward from the plate and configured to prevent one or more foil sheets placed on the plate from sliding off the plate, and c) a telescoping brace attached to the plate so that a part of the brace projects from the proximal end of the plate, the brace comprising a stabilizing cap that contacts the stylist.

4. The apparatus of claim 3 wherein the stabilizing cap is substantially flexible such that the stabilizing cap at least partially conforms to the stylist's chest at the point of contact.

5. An apparatus for aiding in the professional treatment of hair, the apparatus comprising:

a) a substantially rigid rectangular plate having a proximal end and a distal end and comprising a foil surface configured to receive one or more foil sheets and an attachment surface parallel to the foil surface;

b) a pair of tabs integral with the plate and projecting perpendicularly from the foil surface substantially near the corners of the plate at the distal end of the plate, the tabs being configured to cooperate to retain the foil sheets on the foil surface;

c) a telescoping brace comprising:

i. a sheath integral with the plate at the attachment surface;

ii. a shaft slidably engaged with the sheath so that the shaft may be pushed into the sheath to a retracted position, extended proximally from the plate to an extended position, and positioned at one or more intervening positions between the retracted and extended positions; and iii. a locking mechanism attached to the sheath and configured to lock the shaft in the retracted, extended, and intervening positions;

d) a convex, textured stabilizing cap attached to the shaft and configured to contact the stylist at chest level; and e) a wedge-shaped base integral with the plate at the attachment surface and configured to space the proximal end of the plate away from a surface on which the apparatus rests.

* * * * *